US008096622B2

(12) United States Patent
Hussey

(10) Patent No.: US 8,096,622 B2
(45) Date of Patent: Jan. 17, 2012

(54) METHOD OF CONTROLLING MINE FIRES WITH POLYMERIC GEL

(75) Inventor: David A. Hussey, Glenwood Springs, CO (US)

(73) Assignee: Micon, Glassport, PA (US)

( * ) Notice: Subject to any disclaimer, the term of this patent is extended or adjusted under 35 U.S.C. 154(b) by 263 days.

(21) Appl. No.: 12/237,018

(22) Filed: Sep. 24, 2008

(65) Prior Publication Data

US 2009/0078433 A1 Mar. 26, 2009

Related U.S. Application Data

(60) Provisional application No. 60/974,879, filed on Sep. 25, 2007.

(51) Int. Cl.
*E21F 5/00* (2006.01)

(52) U.S. Cl. ..... 299/12

(58) Field of Classification Search ..... 299/10, 299/12

See application file for complete search history.

(56) References Cited

U.S. PATENT DOCUMENTS

| | | | | |
|---|---|---|---|---|
| 3,455,850 | A | 7/1969 | Saunders | |
| 3,791,255 | A | 2/1974 | Fox et al. | |
| 3,927,719 | A * | 12/1975 | Maser | 169/46 |
| 4,237,182 | A * | 12/1980 | Fulmer et al. | 428/305.5 |
| 6,245,252 | B1 | 6/2001 | Hicks et al. | |
| 7,104,336 | B2 | 9/2006 | Ozment | |
| 7,334,644 | B1 | 2/2008 | Ozment | |
| 7,464,992 | B1 * | 12/2008 | Ozment | 299/12 |
| 2003/0212177 | A1 | 11/2003 | Vandersall et al. | |
| 2007/0289752 | A1 * | 12/2007 | Beck et al. | 169/47 |

FOREIGN PATENT DOCUMENTS

| | | | |
|---|---|---|---|
| AU | 67882/87 | A | 8/1987 |
| WO | 03/018695 | A1 | 3/2003 |
| WO | 2006/056379 | A2 | 6/2006 |

* cited by examiner

*Primary Examiner* — John Kreck
(74) *Attorney, Agent, or Firm* — The Webb Law Firm

(57) ABSTRACT

A method is disclosed for controlling a mine fire by delivering a water-absorbent polymeric composition to a rock structure involved in a fire and infusing the polymeric composition into the rock structure. The polymeric composition may also be used to create a seal across a mine entry for controlling underground mine fires.

9 Claims, 4 Drawing Sheets

METHOD OF CONTROLLING MINE FIRES WITH POLYMERIC GEL

RELATED APPLICATION

This application claims the benefits of U.S. Provisional Application No. 60/974,879, filed Sep. 25, 2007, entitled "Method of Controlling Mine Fires with Polymeric Gel", incorporated herein in its entirety.

FIELD OF THE INVENTION

The present invention relates to a method for controlling fires in confined areas, and, more particularly, to controlling fires in underground mines.

BACKGROUND OF THE INVENTION

Mine fires constitute a significant threat to health and safety of personnel working in the underground environment, as well as pose environmental threats and risks to structures above ground in the vicinity of a mine fire. A variety of materials have been used to extinguish fires in underground mines and other confined areas. These materials include water, foam, and the like. While water can remove heat and deprive a fire of oxygen, the water often quickly evaporates before the fire is completely extinguished. Unless water is soaked into the material of the structure on fire, the water evaporates before the fire is extinguished. In addition, only a limited amount of water can even be absorbed into a structure on fire before it evaporates. Water may not readily soak into many structures and simply runs off and is unused. Therefore, a steady supply of water directed onto the fire is required. Significant manpower and a water supply are required to re-apply water and/or re-soak structures from which water falls off, or is evaporated, to provide continued fire protection.

Foams have been used in fire fighting in an effort to apply a more stable material that does not fall off or quickly evaporate. Such foams have been used to control fires in underground mines and other confined areas. In order to prevent the addition of oxygen into the location of a mine fire, nitrogen-expanded foams have been suggested as a fire suppressant in underground mines, as disclosed in U.S. Pat. No. 7,104,336. The area involved in a fire is contacted with a nitrogen-expanded foam that has smothering fire-extinguishing properties, as compared to conventional air-expanded foams. While a nitrogen-expanded foam has structural integrity that can fill a confined area and remain for a period of time in place on a structure, foams cannot flow into, or be pumped into, interstitial gaps within a structure on fire, such as into a coal pillar. Accordingly, while foams can be efficient for suppressing fire in an open area, their use in underground mines for extinguishing fires in a coal pillar, or within a coal stockpile, are limited.

SUMMARY OF THE INVENTION

The present invention relates to a method of controlling a mine fire comprising delivering a water-absorbent polymeric composition to a rock structure involved in a fire and infusing the polymeric composition into the rock structure. The present invention also includes methods of controlling ventilation in an underground mine by delivering a water-absorbent polymeric composition to a mine entry of an area of a mine to be isolated, and filling the mine entry with the polymeric composition to seal off the mine entry. Delivery of the polymeric composition can be made by drilling a bore hole from a location aboveground to a location outby of the area of the mine to be isolated. Also included in the present invention is a mine seal that fills a mine entry comprising a wall produced from a water-absorbent polymeric composition.

DETAILED DESCRIPTION OF THE INVENTION

The present invention is disclosed in connection with the control of a fire in an underground mine. Portions of an underground mine that may be treated by the present invention include, for example, the roof, floor, and/or ribs of a mine entry or a coal pillar. However, the present invention is not limited thereto and includes all other confined areas, such as sites that normally have limited ventilation and access for extinguishing a fire or the like. In such confined areas, the by-products of a combustion may accumulate and pose a threat to personnel attempting to extinguish such a fire.

The present invention is directed to a method for extinguishing a fire in a confined area, such as a mine entry, by contacting the involved area with a water-absorbent polymeric composition. The water-absorbent polymeric composition used in the method of the present invention includes polymer particles that absorb significant quantities of water relative to the size and weight of the particles and may include a thickener that results in a relatively high viscosity composition. Suitable polymeric particles are produced from hydrophilic monomers, such as those disclosed in U.S. Pat. No. 6,245,252, incorporated herein by reference. The polymeric composition is produced by mixing of the polymer particles with water, whereupon the polymer particles absorb significant quantities of water. Viscosity modifying additives may be included in the polymeric composition to increase the viscosity for applications requiring structural integrity to the polymeric composition. The polymeric compositions delivered to a fire contain significant quantities of water that is releasable onto the fire. The water-laden particles can be injected or infused into interstitial gaps within the structure involved in a fire (such as a coal pillar) to inject the fire-suppressant material directly onto the fire and extinguish the fire at or near its origin. Rock strata, such as in an underground mine, inherently has cracks and gaps into which the polymeric composition is delivered. While water alone can be injected into rock strata involved in a fire, the water typically evaporates before it reaches the flames and is not effective. In contrast, the polymeric composition used in the present invention has more surface area than a water molecule, thereby slowing the evaporation process. More water reaches the fire and the fire is doused with less water than when using water alone or when using fire-fighting foams. The polymeric composition used in the present invention can contain at least 30 wt. % water and up to more than 90 wt. % water.

Figure 1:
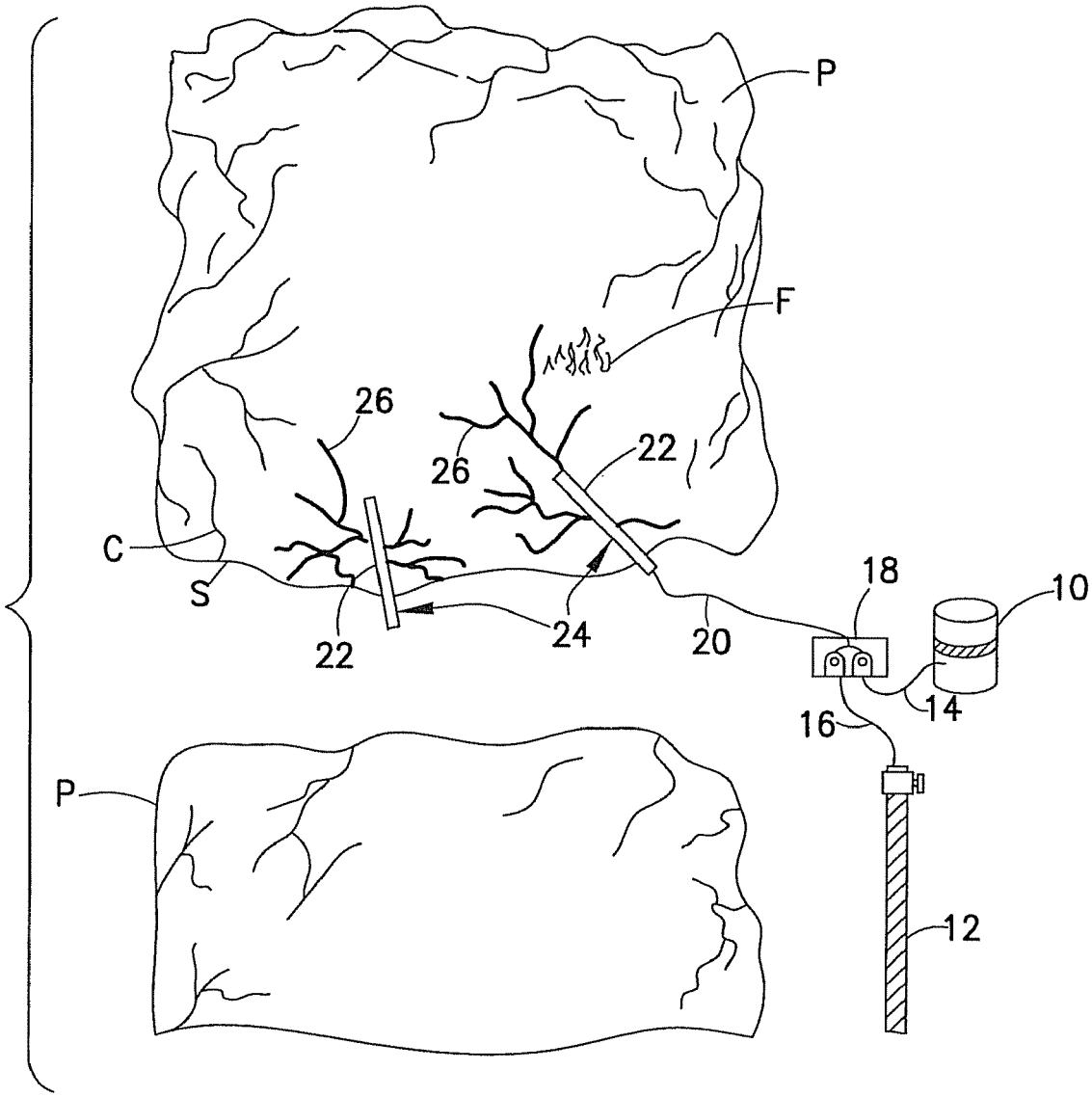
FIG. 1 is a plan view of a portion of a mine entry with a coal pillar on fire being treated according to the method of the present invention.

Referring to FIG. 1, a water-absorbent polymeric composition is delivered to a coal pillar P involved in a fire F. In one embodiment, the polymer particles are suspended in water (such as in an amount of about ½ to 3 wt. % or more) and provided in a container 10 that is transportable to an underground location. Water is provided via any conventional water supply system, such as a supply line 12. The suspended polymer particles and water are pumped via respective pump lines 14 and 16 via a pump 18 into a single delivery line 20. The pump 18 may be a dual-piston pump or other pump for receiving two compositions and mixing the compositions together. Pump 18 may include a mixing device (not shown) such as a static mixer or an eductor, or the like. The polymeric composition may be delivered directly to the rock strata at a surface S of the coal pillar P, via a nozzle (not shown), or the like, that may be inserted into cracks or gaps C in the coal pillar P. Alternatively, to reach the interior of the coal pillar P, bore holes 22 are drilled to a desired depth and the polymeric composition is delivered into the bore holes 22 via a bore hole packer 24. The polymeric composition is pumped into and fills the interstitial gaps or cracks as at 26. By pumping the polymeric composition into the interior of the coal pillar P, the fire is suppressed at or near its origin. After treatment, composition delivery line 20 is moved to another area of the coal pillar P requiring fire control treatment, with the bore hole packer 24 typically remaining in place. The polymeric composition suppresses the fire due to the presence of water. In addition, the filled cracks 26 serve to block the passage of air into the interior of the coal pillar P and starve the fire of oxygen. The polymeric composition also may be applied to the surface S to protect the coal pillar P as a whole.

Figure 2:
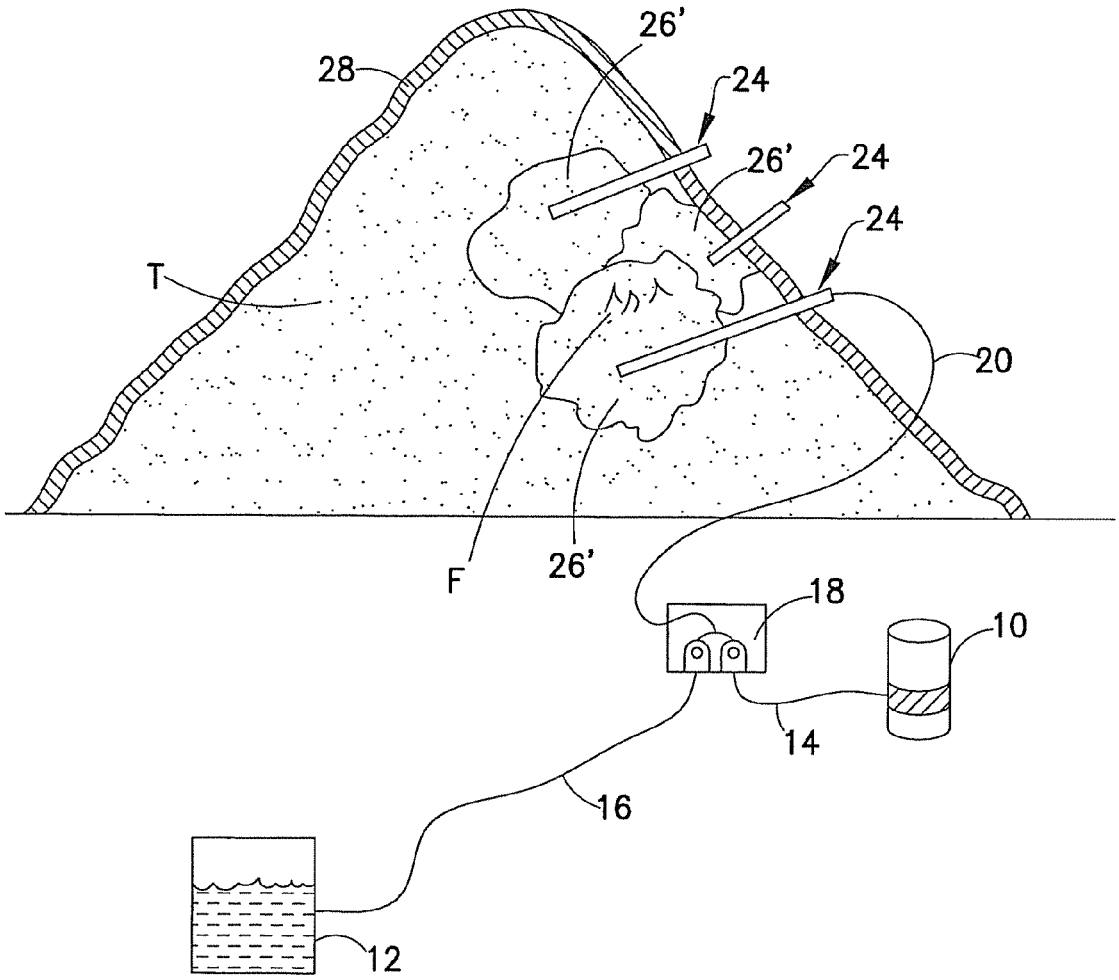
FIG. 2 is an elevation view of a coal stockpile treated according to the method of the present invention.

Referring to FIG. 2, a coal stockpile T of loose coal may be treated in a similar manner. The coal stockpile T may be underground or aboveground. The bore hole packer 24 is inserted into the coal stockpile T, which may or may not require providing a pilot hole or bore hole into the stockpile T to ease insertion of the bore hole packer 24. The polymeric composition flows from the delivery line 20 and bore hole packer 24 into locations within the coal stockpile T and spreads through the loose coal to create regions 26' in the stockpile. The polymeric composition in the regions 26' eventually dries and does not negatively impact the coal treated therewith. In addition, the exterior surfaces of the coal stockpile T may be coated with the polymeric composition as at 28 to protect the stockpile as a whole.

Figure 3:
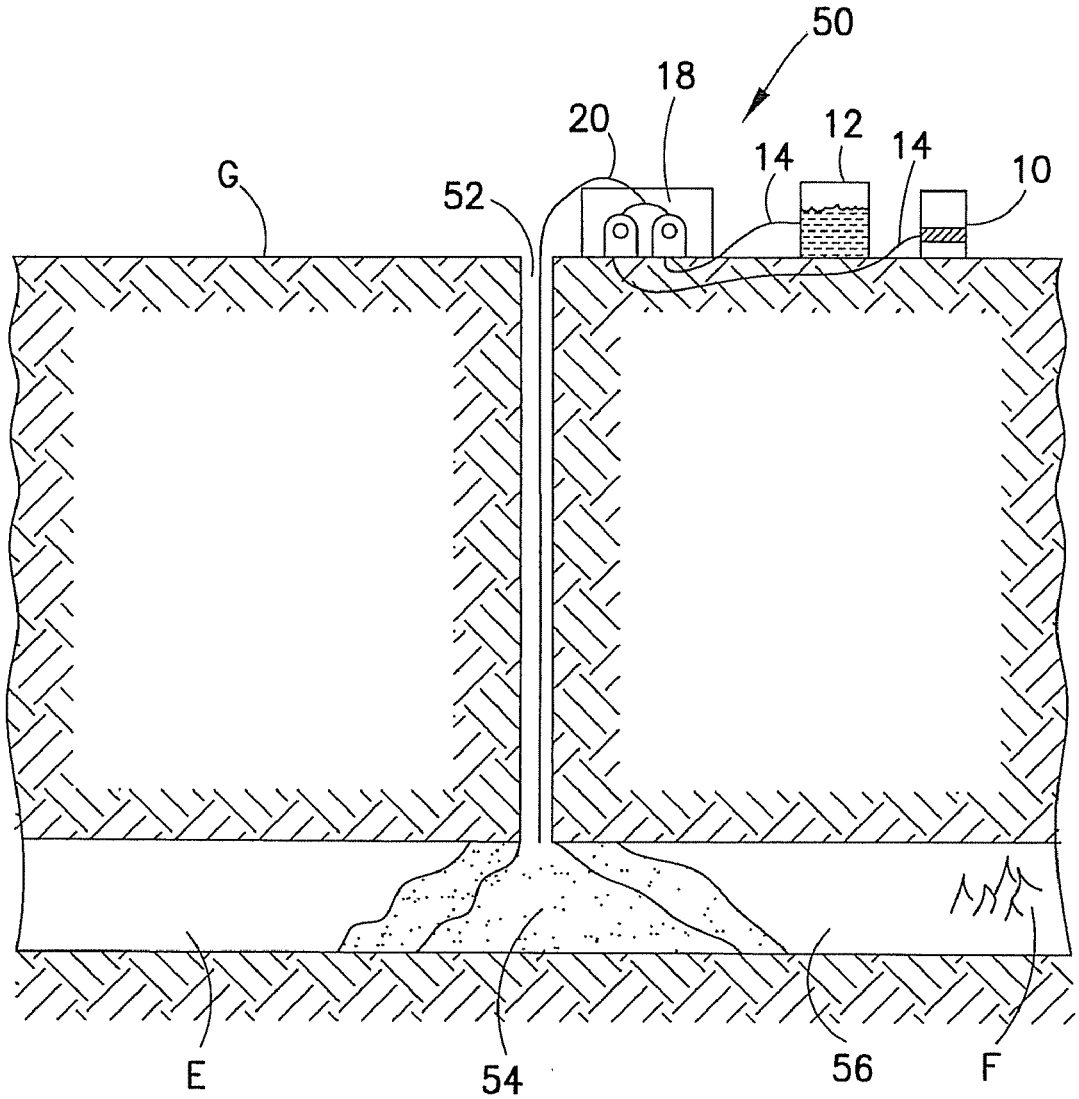
FIG. 3 is a cross-section of a mine entry showing treatment to control a mine fire by delivery from the surface above ground.
Figure 4:
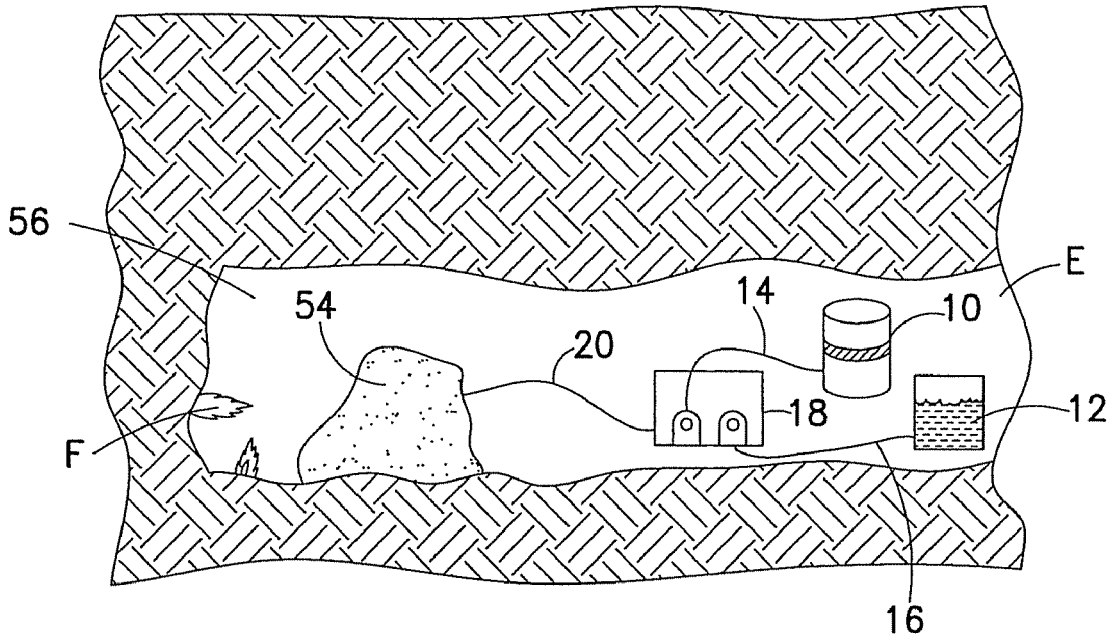
FIG. 4 is a cross-section of a mine entry in which a seal of the present invention is under construction.
Figure 5:
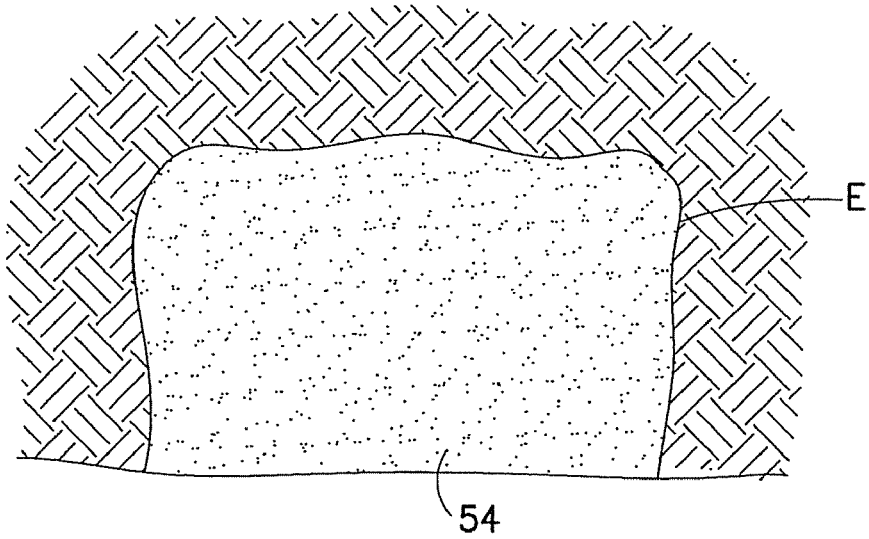
FIG. 5 is an elevation view of a seal produced according to the method of the present invention.

Referring to FIG. 3, a system 50 for producing a fire control seal is shown. Access to mine entry E in which a fire is involved may be achieved via a pre-existing vent shaft or a bore hole, or the like, as at 52 that is drilled from the aboveground surface G. The polymeric composition is delivered from container 10 and water supply 12 via lines 14, 16 and pump 18 to the delivery line 20 in a similar manner as described above for treating a coal pillar P or coal stockpile T. The system 50 delivers the polymeric composition to the mine entry E so that the polymeric composition piles up to form a wall 54 outby the location of the fire F. The polymeric composition has a viscosity and structural integrity that allows it to completely fill the mine entry E, such as shown in FIG. 5. The viscosity may be adjusted (i.e., increased) so that the applied polymeric composition remains stable and does not readily flow off the structure onto which it is applied or may be piled up as at 54. The wall 54 may be constructed by applying multiple layers of the polymeric composition having the same or varying viscosities. Alternatively, the polymeric composition can be delivered from within the mine, as shown in FIG. 4, to construct the wall 54 from the polymeric composition.

In another embodiment, the polymeric composition further includes an additive that expands upon contact with water. Suitable expansion additives include materials such as bentonite, and may include organic materials that are inflammable, yet expand upon contact with water.

By filling the mine entry, as shown in FIG. 5, the resulting wall 54 of the polymeric composition cuts off the air supply to an isolated portion 56 of the mine entry involved in the fire F, thereby functioning as a mine seal. The wall 54 creates the chamber or isolated portion 56 that separates the fire F from the uninvolved portion of the mine entry E. In addition, the wall 54 can be constructed as a fire break to prevent further spread of a fire in a mine entry E. An inert gas, such as nitrogen or the like, may be delivered into the isolated portion 56 of the mine entry E to eliminate oxygen from the isolated portion 56 and starve the fire. The wall 54 may be constructed from the polymeric composition alone. Alternatively, other structural components may be used for building a mine seal (such as concrete or polymeric blocks, metal panels or the like) with an overcoating of the polymeric composition.

All of the preferred embodiments of the present invention are described above. Obvious modifications and alterations of the present invention may be made without departing from the spirit and scope of the present invention. The scope of the present invention is defined in the appended claims and equivalents thereto.

The invention claimed is:

1. A method of controlling a mine fire comprising:
drilling a bore hole in an underground rock structure;
delivering a water-absorbent polymeric composition directly through the bore hole and into interstitial openings in the underground rock structure involved in a fire;
infusing the polymeric composition into the interstitial openings in the rock structure; and
extinguishing the fire.

2. The method of claim 1, wherein the polymeric composition comprises polymeric particles and at least 50 wt. % water.

3. The method of claim 2, further comprising mixing water and the polymeric particles to produce the polymeric composition.

4. The method of claim 1, wherein said delivering step comprises pumping the polymeric composition to the rock structure.

5. The method of claim 1, wherein the polymeric composition comprises particles produced from hydrophilic monomers.

6. The method of claim 1, wherein the polymeric composition is delivered under pressure through a bore hole packer.

7. The method of claim 1, further comprising adjusting the viscosity of the polymeric composition.

8. The method of claim 1, further comprising coating a surface of the rock structure with the polymeric composition.

9. A method of controlling a mine fire comprising:
providing a bore hole in an underground rock structure;
delivering a water-absorbent polymeric composition directly through the bore hole and into interstitial openings in the underground rock structure involved in a fire;
infusing the polymeric composition into the interstitial openings in the rock structure; and
extinguishing the fire.

* * * * *